US008349389B2

(12) United States Patent
Harold et al.

(10) Patent No.: US 8,349,389 B2
(45) Date of Patent: Jan. 8, 2013

(54) STENT FIXTURE HAVING ROUNDED SUPPORT STRUCTURES AND METHOD FOR USE THEREOF

(75) Inventors: Nathan Harold, San Jose, CA (US); Antonio Garcia, San Jose, CA (US); Andrew Tochterman, Palo Alto, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 268 days.

(21) Appl. No.: 12/778,914

(22) Filed: May 12, 2010

(65) Prior Publication Data

US 2010/0221409 A1 Sep. 2, 2010

Related U.S. Application Data

(62) Division of application No. 11/193,849, filed on Jul. 28, 2005, now Pat. No. 7,735,449.

(51) Int. Cl.

| | |
|---|---|
| ***B05D 3/02*** | (2006.01) |
| ***B05D 1/02*** | (2006.01) |
| ***B05C 13/00*** | (2006.01) |
| ***B05B 13/02*** | (2006.01) |

(52) U.S. Cl. .... 427/2.24; 427/2.1; 427/2.25; 427/372.2; 18/305; 18/320; 18/500

(58) Field of Classification Search ..... 427/2.1, 427/2.24, 2.25; 118/500
See application file for complete search history.

(56) References Cited

U.S. PATENT DOCUMENTS

| | | | | |
|---|---|---|---|---|
| 4,733,665 | A | 3/1988 | Palmaz | |
| 4,800,882 | A | 1/1989 | Gianturco | |
| 4,886,062 | A | 12/1989 | Wiktor | |
| 6,527,863 | B1 * | 3/2003 | Pacetti et al. | 118/500 |
| 6,695,920 | B1 | 2/2004 | Pacetti et al. | |
| 6,972,054 | B2 | 12/2005 | Kerrigan | |
| 7,074,276 | B1 | 7/2006 | Van Sciver et al. | |
| 7,175,874 | B1 | 2/2007 | Pacetti | |
| 7,323,209 | B1 | 1/2008 | Esbeck et al. | |
| 7,335,265 | B1 | 2/2008 | Hossainy | |
| 7,335,391 | B1 | 2/2008 | Pacetti | |
| 7,354,480 | B1 * | 4/2008 | Kokish et al. | 118/500 |
| 7,404,979 | B1 | 7/2008 | Pacetti | |
| 7,416,609 | B1 * | 8/2008 | Madriaga et al. | 118/500 |
| 7,504,125 | B1 | 3/2009 | Pacetti et al. | |
| 7,628,859 | B1 | 12/2009 | Hossainy et al. | |
| 7,776,381 | B1 | 8/2010 | Tang et al. | |
| 2002/0065548 | A1 * | 5/2002 | Birdsall et al. | 623/1.15 |
| 2004/0062853 | A1 * | 4/2004 | Pacetti et al. | 427/2.1 |
| 2004/0182312 | A1 | 9/2004 | Pacetti | |
| 2005/0261764 | A1 | 11/2005 | Pacetti et al. | |
| 2007/0003688 | A1 * | 1/2007 | Chen et al. | 427/2.24 |

OTHER PUBLICATIONS

U.S. Appl. No. 10/750,312, filed Dec. 30, 2003, Desnoyer et al.
U.S. Appl. No. 10/805,047, filed Mar. 18, 2004, Yip et al.

* cited by examiner

*Primary Examiner* — Timothy Meeks
*Assistant Examiner* — Cachet Sellman
(74) *Attorney, Agent, or Firm* — Squire Sanders (US) LLP

(57) ABSTRACT

A stent fixture for supporting a stent during the application of a coating substance is provided.

24 Claims, 4 Drawing Sheets

STENT FIXTURE HAVING ROUNDED SUPPORT STRUCTURES AND METHOD FOR USE THEREOF

This application is a divisional of U.S. application Ser. No. 11/193,849, now U.S. Pat. No. 7,735,449, filed Jul. 28, 2005.

TECHNICAL FIELD

This invention relates generally to stent fixtures, and more particularly, but not exclusively, provides a stent mandrel having spherical support structures and method for use thereof that reduce coating defects on stents.

BACKGROUND

Blood vessel occlusions are commonly treated by mechanically enhancing blood flow in the affected vessels, such as by employing a stent. Stents act as scaffoldings, functioning to physically hold open and, if desired, to expand the wall of affected vessels. Typically stents are capable of being compressed, so that they can be inserted through small lumens via catheters, and then expanded to a larger diameter once they are at the desired location. Examples in the patent literature disclosing stents include U.S. Pat. No. 4,733,665 issued to Palmaz, U.S. Pat. No. 4,800,882 issued to Gianturco, and U.S. Pat. No. 4,886,062 issued to Wiktor.

FIG. 1 illustrates a conventional stent 10 formed from a plurality of struts 12. The plurality of struts 12 are radially expandable and interconnected by connecting elements 14 that are disposed between the adjacent struts 12, leaving lateral openings or gaps 16 between the adjacent struts 12. The struts 12 and the connecting elements 14 define a tubular stent body having an outer, tissue-contacting surface and an inner surface.

Stents are used not only for mechanical intervention but also as vehicles for providing biological therapy. Biological therapy can be achieved by medicating the stents. Medicated stents provide for the local administration of a therapeutic substance at the diseased site. Local delivery of a therapeutic substance is a preferred method of treatment because the substance is concentrated at a specific site and thus smaller total levels of medication can be administered in comparison to systemic dosages that often produce adverse or even toxic side effects for the patient.

One method of medicating a stent involves the use of a polymeric carrier coated onto the surface of the stent. A composition including a solvent, a polymer dissolved in the solvent, and a therapeutic substance dispersed in the blend is applied to the stent by immersing the stent in the composition or by spraying the composition onto the stent. The solvent is allowed to evaporate, leaving on the stent strut surfaces a coating of the polymer and the therapeutic substance impregnated in the polymer.

A shortcoming of the above-described method of medicating a stent is the potential for coating defects. While some coating defects can be minimized by adjusting the coating parameters, other defects occur due to the nature of the interface between the stent and the apparatus on which the stent is supported during the coating process. A high degree of surface contact between the stent and the supporting apparatus can provide regions in which the liquid composition can flow, wick, and collect as the composition is applied. As the solvent evaporates, the excess composition hardens to form excess coating at and around the contact points between the stent and the supporting apparatus. Upon the removal of the coated stent from the supporting apparatus, the excess coating may stick to the apparatus, thereby removing some of the coating from the stent and leaving bare areas. Alternatively, the excess coating may stick to the stent, thereby leaving excess coating as clumps or pools on the struts or webbing between the struts.

Accordingly, a new stent and method of use are needed to minimize coating defects.

SUMMARY

A stent fixture for supporting a stent during a coating process is provided comprising a member for being inserted at least partially into a longitudinal bore of a stent, the member having at least one spherical component for making contact with the stent. The fixture can additionally comprise a second member coupled to one end of the member and a third member coupled to the other end of the member. The second and third members can be in constant contact with the stent during the coating process. In some embodiments, the second and third member can be in interim contact with the stent during the coating process. In some embodiments, the stent is capable of moving back and forth between the second and third members during the coating process.

In some embodiments, the spherical component penetrates through a gap between struts of the stent such that a surface of the spherical component project out from an outer surface of the stent. In some embodiments, the spherical component penetrates at least minimally through a gap between struts of the stent such that the surface of the spherical component does not project out from an outer surface of the stent. The spherical component can prevent the member from making contact with the stent. The spherical component can be moved incrementally with respect to the member for repositioning of the spherical component on the member.

In accordance with another aspect of the invention, methods of coating a stent using the above-described fixtures are provided.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

The following description is provided to enable any person having ordinary skill in the art to make and use the invention, and is provided in the context of a particular application and its requirements. Various modifications to the embodiments will be readily apparent to those skilled in the art, and the generic principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1:
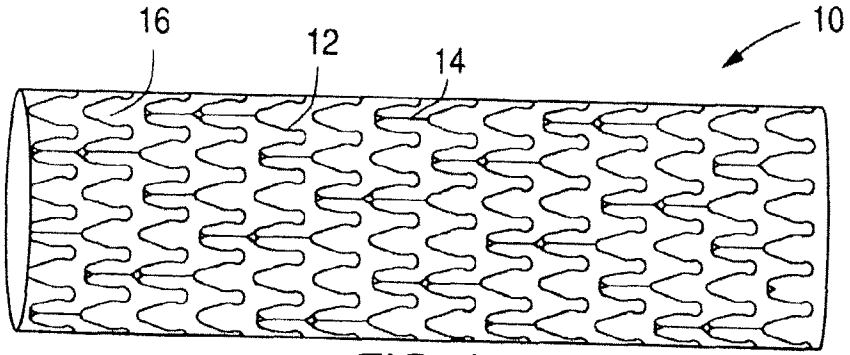
FIG. 1 Prior Art
FIG. 1 is a diagram illustrating a conventional stent.
Figure 2:
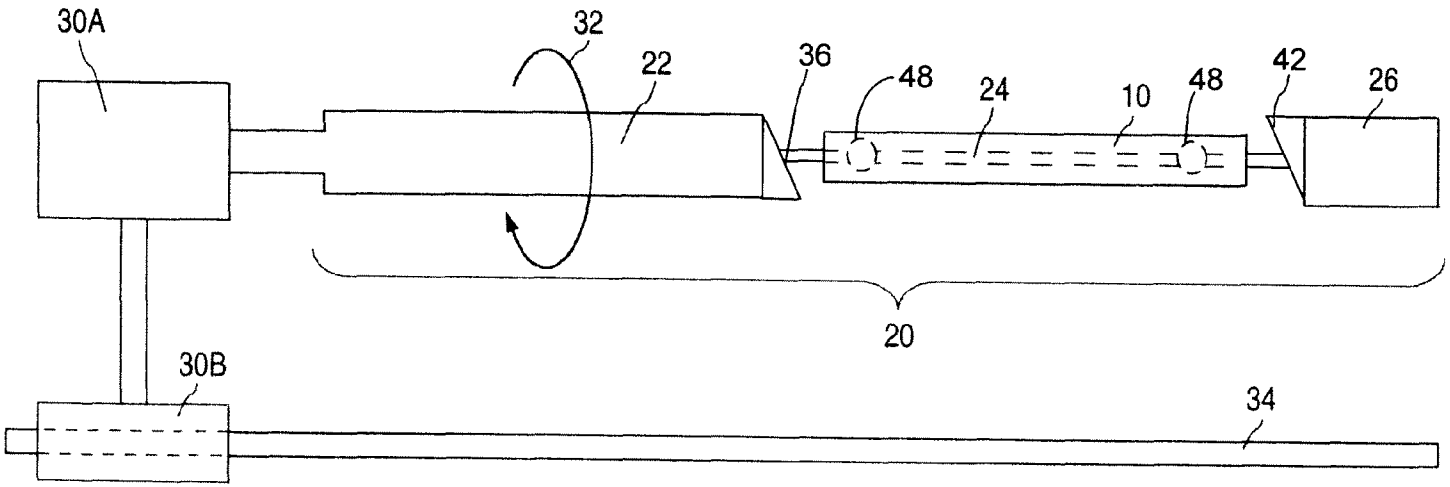
FIG. 2 is a diagram illustrating a stent fixture in accordance with an embodiment of the invention.

FIG. 2 illustrates a stent fixture 20 in accordance with an embodiment of the invention. The fixture 20 for supporting the stent 10 is illustrated to include a support member 22, a mandrel 24, and a lock member 26. The support member 22 can connect to a motor 30A so as to provide rotational motion about the longitudinal axis of the stent 10, as depicted by arrow 32, during a coating process (which can include spraying and/or drying such as by application of a gas). Another motor 30B can also be provided for moving the support member 22 in a linear direction, back and forth, along a rail 34.

Figure 3:
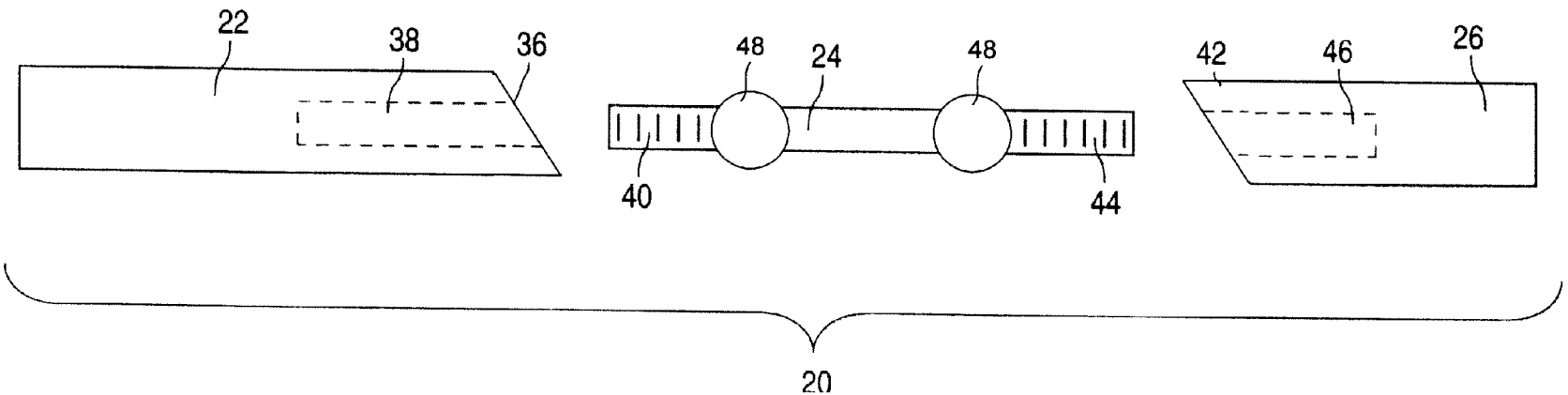
FIG. 3 is a diagram illustrating an expanded view of stent fixture of FIG. 2.

FIG. 3 illustrates an expanded view of the stent fixture 20. The support member 22 can include a slanted end 36, slanting at an angle $\phi_1$ of about 15° to about 75°, more narrowly from about 30° to about 60°. By way of example, angle $\phi_1$ can be about 45°. In some embodiments the slanted end 36 is in constant contact with its respective end of the stent 10 during the coating process. In some embodiments, the stent 10 can moved back and forth during the coating process with respect to the mandrel 24 so as to provide interim contact with the slanted end 36. In yet other embodiments, the stent 10 does not contact the slanted end 36 during the coating process. In some embodiments, the size of the slanted end 36 should be large enough so as to prevent the slanted end 36 from penetrating into the longitudinal bore of the stent 10—as positioned on the fixture 20. Since the stent 10 can vary in size, when referring to the inner/outer diameter of the stent 10, unless otherwise specifically stated, the measurement is as positioned on the fixture. In accordance with one embodiment of the invention, the mandrel 24 can be permanently affixed to the slanted end 36. Alternatively, the support member 22 can include a bore 38 for receiving a first end 40 of the mandrel 24. The first end 40 of the mandrel 24 can be threaded to screw into the bore 38 or, alternatively, can be retained within the bore 38 by a friction fit. The bore 38 should be deep enough so as to allow the mandrel 24 to securely mate with the support member 22. The depth of the bore 38 can also be over-extended so as to allow a significant length of the mandrel 24 to penetrate or screw into the bore 38. The bore 38 can also extend completely through the support member 22. This would allow the length of the mandrel 24 to be adjusted to accommodate stents of various sizes.

The outer diameter of the mandrel 24 can be smaller than the inner diameter of the stent 10 so as to prevent the outer surface of the mandrel 24 from making contact with the inner surface of the stent 10. A sufficient clearance between the outer surface of the mandrel 24 and the inner surface of the stent 10 should be provided to prevent the mandrel 24 from obstructing the pattern of the stent body during the coating process. By way of example, the outer diameter of the mandrel 24 can be from about 0.010 inches (0.254 mm) to about 0.017 inches (0.432 mm) when the stent 10 has an inner diameter of between about 0.025 inches (0.635 mm) and about 0.035 inches (0.889 mm) when mounted on the fixture 20. The mandrel 24 should be longer than the stent 10 mounted thereon.

The mandrel 24 has at least one sphere 48 disposed thereon (e.g., at the middle of the stent 10) so as to prevent or minimize stent/mandrel contact. In an embodiment of the invention, the mandrel 24 has two spheres 48, each located adjacent to an end region of the mandrel 24. In some embodiments, the spheres 48 and the mandrel 24 are concentered about the same axis of rotation such that a longitudinal center axis of the mandrel 24 runs through the center of the spheres 48. Alternatively, the spheres 48 can be shifted with respect to the mandrel 24 such that the center axis of rotation of the mandrel 24 is off-set from the axis of rotation of the spheres 48.

In an embodiment of the invention, the spheres 48 can have a diameter up to about 90% of the stent 10 inner diameter, e.g., up to about 0.0225 inches for a stent having an inner diameter of 0.025 inches when mounted on the fixture 20. In some embodiments the diameter of the spheres 48 is large enough such that a surface of the spheres 48 does not extend out from an outer surface of the stent 10 through the gap regions 16. Accordingly, a segment of the spheres 48 will be placed inset the gapped region 16, without protruding out from the surface of the stent 10. In some embodiments, the diameter of the spheres 48 is small enough that at least a portion of the spheres 48 extends out through the gap 16 and above an outer surface of the stent 10. In either embodiment, the spheres 48 should function in part to prevent or minimize stent/mandrel contact.

The spheres 48 can be integral with the mandrel 24, e.g., the mandrel 24 and the spheres 48 could be formed from a single mold, or the spheres 48 can be coupled to the mandrel 24. In some embodiments, the positioning of the spheres 48 is adjustable with respect to the mandrel 24. In some embodiments, the spheres 48 can be incrementally moved with respect to the mandrel 24. Accordingly, the mandrel 24 and sphere 48 combination should include means for allowing the spheres 48 to be moved incrementally with respect to the mandrel 24 such as a thread/screw type assembly, a teeth/lock engagement or the like.

The lock member 26 includes a slanted end 42 having a slanted angle $\phi_2$. Angle $\phi_2$ can be the same as or different than the above-described angle $\phi_1$. As best illustrated by the figures, the slanted end 42 can slant in an opposing direction to the slanted end 36. As a result, when the surface of the slanted end 36 is facing a spray nozzle or a gas nozzle, the surface of the slanted end 42 is facing away from the nozzle. Should the spacing between the slanted ends 36 and 42 be larger than the length of the stent, spray or gas applications bouncing off of the slanted ends 36 and 42 can cause the movement of the stent back and forth as the fixture 20 rotates. In some embodiments, the stent 10 can be securely pinched between the slanted ends 36 and 42 so as to be in constant contact with the stent during the coating process.

A second end 44 of the mandrel 24 can be permanently affixed to the lock member 26 if the end 40 is disengagable from the support member 22. Alternatively, in accordance with another embodiment, the mandrel 24 can have a threaded second end 44 for screwing into a bore 46 of the lock member 26. The bore 46 can be of any suitable depth that would allow the lock member 26 to be incrementally moved closer to the support member 22. The bore 46 can also extend completely through the lock member 26. Accordingly, the stents 10 of any length can be securely pinched between the support and the lock members 22 and 26. In accordance with yet another embodiment, a non-threaded second end 44 and the bore 46 combination is employed such that the second end 44 can be press-fitted or friction-fitted within the bore 46 to prevent movement of the stent 10 on the stent mandrel fixture 20.

During a spray coating process, the stent 10 rests on the spheres 48, which prevent the stent 10 from contacting the mandrel 24. Further, as the mandrel 24 rotates, the stent 10 also rotates, but not at 1:1 ratio since the stent 10 is not coupled to the spheres 48. As such, the point of contact between the inner diameter of the stent 10 and the spheres 48 constantly changes. Due to the constantly changing points of contact, the collection of excess coating at a single point is prevented, thereby minimizing the formation of clumps, which can lead to further defects, such as tears and rough surfaces, when the stent 10 is removed from the fixture 20. In addition, coating and/or air deflected from the slanted ends 36 and 42 cause translational motion of the stent 10 relative to the mandrel 24, thereby limiting contact of the stent 10 with the ends 36 and 42. In an embodiment of the invention, the slanted ends 36 and 42 are slanted in opposite directions such that the coating and/or the air is only deflected off on one of the ends 36 and 42 at a time.

In order to further reduce coating defects, the spheres 48 may be coated with one or more materials such as polymeric material having less adhesive force with the coating substance than with the spheres 48. Examples of a suitable materials include poly (tetrafluor ethylene) (e.g., TEFLON), fluorinated ethylene propylene ("FEP"), poly (vinylidene fluoride) ("PVDF"), poly (para—xylyene), polyamide (Nylon), polyolefins (e.g., high density poly (ethylene) and poly (propylene)), and polyacetal (DELRIN). In an alternative embodiment of the invention, the spheres 48 may be made of one or more of the non-stick polymeric materials.

The components of the coating substance or composition can include a solvent or a solvent system comprising multiple solvents, a polymer or a combination of polymers, a therapeutic substance or a drug or a combination of drugs. In some embodiments, the coating substance can be exclusively a polymer or a combination of polymers (e.g., for application of a primer layer or topcoat layer). In some embodiments, the coating substance can be a drug that is polymer free. Polymers can be biostable, bioabsorbable, biodegradable, or bioerodable. Biostable refers to polymers that are not biodegradable. The terms biodegradable, bioabsorbable, and bioerodable are used interchangeably and refer to polymers that are capable of being completely degraded and/or eroded when exposed to bodily fluids such as blood and can be gradually resorbed, absorbed, and/or eliminated by the body. The polymers can also be of the type that can be easily excreted from the body. The processes of breaking down and eventual absorption and elimination of the polymer can be caused by, for example, hydrolysis, metabolic processes, bulk or surface erosion, and the like.

Representative examples of polymers that may be used include, but are not limited to, poly(N-acetylglucosamine) (Chitin), Chitoson, poly(hydroxyvalerate), poly(lactide-co-glycolide), poly(hydroxybutyrate), poly(hydroxybutyrate-co-valerate), polyorthoester, polyanhydride, poly(glycolic acid), poly(glycolide), poly(L-lactic acid), poly(L-lactide), poly(D,L-lactic acid), poly(D,L-lactide), poly(D-lactic acid), poly(D-lactide), poly(caprolactone), poly(trimethylene carbonate), polyester amide, poly(glycolic acid-co-trimethylene carbonate), co-poly(ether-esters) (e.g. PEO/PLA), polyphosphazenes, biomolecules (such as fibrin, fibrinogen, cellulose, starch, collagen and hyaluronic acid), polyurethanes, silicones, polyesters, polyolefins, polyisobutylene and ethylene-alphaolefin copolymers, acrylic polymers and copolymers other than polyacrylates, vinyl halide polymers and copolymers (such as polyvinyl chloride), polyvinyl ethers (such as polyvinyl methyl ether), polyvinylidene halides (such as polyvinylidene chloride), polyacrylonitrile, polyvinyl ketones, polyvinyl aromatics (such as polystyrene), polyvinyl esters (such as polyvinyl acetate), acrylonitrile-styrene copolymers, ABS resins, polyamides (such as Nylon 66 and polycaprolactam), polycarbonates, polyoxymethylenes, polyimides, polyethers, polyurethanes, rayon, rayon-triacetate, cellulose, cellulose acetate, cellulose butyrate, cellulose acetate butyrate, cellophane, cellulose nitrate, cellulose propionate, cellulose ethers, and carboxymethyl cellulose. Representative examples of polymers that may be especially well suited for use include ethylene vinyl alcohol copolymer (commonly known by the generic name EVOH or by the trade name EVAL), poly(butyl methacrylate), poly(vinylidene fluoride-co-hexafluororpropene) (e.g., SOLEF 21508, available from Solvay Solexis PVDF, Thorofare, N.J.), polyvinylidene fluoride (otherwise known as KYNAR, available from ATOFINA Chemicals, Philadelphia, PA.), ethylene-vinyl acetate copolymers, and polyethylene glycol.

"Solvent" is defined as a liquid substance or composition that is compatible with the polymer and/or drug and is capable of dissolving the polymer and/or drug at the concentration desired in the composition. Examples of solvents include, but are not limited to, dimethylsulfoxide, chloroform, acetone, water (buffered saline), xylene, methanol, ethanol, 1-propanol, tetrahydrofuran, 1-butanone, dimethylformamide, dimethylacetamide, cyclohexanone, ethyl acetate, methylethylketone, propylene glycol monomethylether, isopropanol, isopropanol admixed with water, N-methyl pyrrolidinone, toluene, and mixtures and combinations thereof.

The therapeutic substance or drug can include any substance capable of exerting a therapeutic or prophylactic effect. Examples of active agents include antiproliferative substances such as actinomycin D, or derivatives and analogs thereof (manufactured by Sigma-Aldrich 1001 West Saint Paul Avenue, Milwaukee, Wis. 53233; or COSMEGEN available from Merck). Synonyms of actinomycin D include dactinomycin, actinomycin IV, actinomycin $I_1$, actinomycin $X_1$, and actinomycin $C_1$. The bioactive agent can also fall under the genus of antineoplastic, anti-inflammatory, antiplatelet, anticoagulant, antifibrin, antithrombin, antimitotic, antibiotic, antiallergic and antioxidant substances. Examples of such antineoplastics and/or antimitotics include paclitaxel, (e.g., TAXOL® by Bristol-Myers Squibb Co., Stamford, Conn.), docetaxel (e.g., Taxotere®, from Aventis S.A., Frankfurt, Germany), methotrexate, azathioprine, vincristine, vinblastine, fluorouracil, doxorubicin hydrochloride (e.g., Adriamycin® from Pharmacia & Upjohn, Peapack N.J.), and mitomycin (e.g., Mutamycin® from Bristol-Myers Squibb Co., Stamford, Conn.). Examples of such antiplatelets, anticoagulants, antifibrin, and antithrombins include aspirin, sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein IIb/IIIa platelet membrane receptor antagonist antibody, recombinant hirudin, and thrombin inhibitors such as Angiomax ä (Biogen, Inc., Cambridge, Mass.). Examples of such cytostatic or antiproliferative agents include angiopeptin, angiotensin converting enzyme inhibitors such as captopril (e.g., Capoten® and Capozide® from Bristol-Myers Squibb Co., Stamford, Conn.), cilazapril or lisinopril (e.g., Prinivil® and Prinzide® from Merck & Co., Inc., Whitehouse Station, N.J.), calcium channel blockers (such as nifedipine), colchicine, proteins, peptides, fibroblast growth factor (FGF) antagonists, fish oil (omega 3-fatty acid), histamine antagonists, lovastatin (an inhibitor of HMG-CoA reductase, a cholesterol lowering drug, brand name Mevacor® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is permirolast potassium. Other therapeutic substances or agents which may be appropriate agents include cisplatin, insulin sensitizers, receptor tyrosine kinase inhibitors, carboplatin, alpha-interferon, genetically engineered epithelial cells, steroidal anti-inflammatory agents, non-steroidal anti-inflammatory agents, antivirals, anticancer drugs, anticoagulant agents, free radical scavengers, estradiol, antibiotics, nitric oxide donors, super oxide dismutases, super oxide dismutases mimics, 4-amino-2,2,6,6-tetramethylpiperidine-1-oxyl (4-amino-TEMPO), tacrolimus, dexamethasone, ABT-578, clobetasol, cytostatic agents, prodrugs thereof, co-drugs thereof, and a combination thereof Other therapeutic substances or agents may include rapamycin and structural derivatives or functional analogs thereof, such as 40-O-(2-hydroxy)ethyl-rapamycin (everolimus), 40-O-(3-hydroxy) propyl-rapamycin, 40-O-[2-(2-hydroxy)ethoxy]ethyl-rapamycin, and 40-O-tetrazole-rapamycin.

Figure 4:
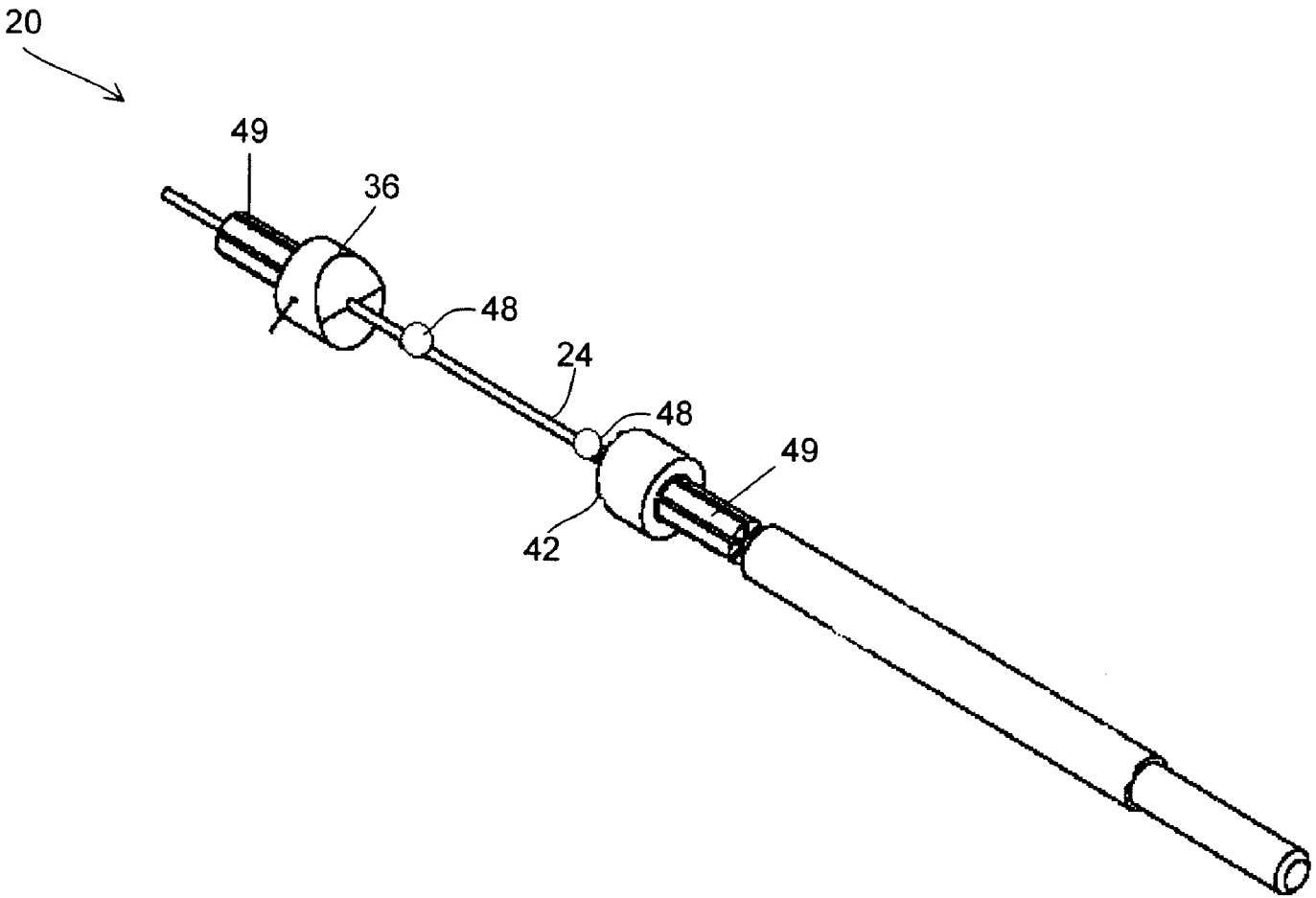
FIG. 4 is a diagram illustrating a perspective view of the stent fixture in accordance with another embodiment of the invention.

FIG. 4 is a diagram illustrating a perspective view of the stent mandrel fixture 20. In an embodiment of the invention, the mandrel 24 can be manufactured from nickel titanium. The spheres 48 can be made from stainless steel or other drug delivery stent manufacturing friendly materials. As mentioned above, to further reduce the likelihood of mandrel/stent interaction, the spheres 48 can be coated with a Teflon or Parylene-like coating to minimize the stent 10 sticking to the coating during processing. In an embodiment of the invention, the fixture 20 includes slotted pieces 20 coupled to the members 22 and 26. These slotted tubes 49 provide a friction fit for the members 22 and 26. They enable the slanted members 22 and 26 to be easily removed and replaced onto the mandrel 24.

It will be appreciated by one of ordinary skill in the art that the support member 22 and the lock member 26 can have different shapes. For example, the support member 22 and the lock member 26 can each have flat or tapered shapes. Further, the support member 26 and the lock member 26 do not need to have identical shapes.

Accordingly, as compared to conventional mandrels, embodiments of the invention reduce loading/unloading coating damage as the spheres 48 enable simple, smoother geometry that facilitates loading and unloading, thereby decreasing the likelihood of damaging coating on the stent 10 as compared to mandrels having coils thereon. Further, embodiments of the invention reduce coating damage during spray coating as the spheres 48 reduce the likelihood of coating accumulation and scraping of the inner stent 10 surface because of the spheres' 48 smooth surfaces. The mandrel 24 also enables tumbling of the stent 10 during a coating process, thereby enabling a more even distribution of coating on surfaces as compared to conventional mandrels.

Figure 5:
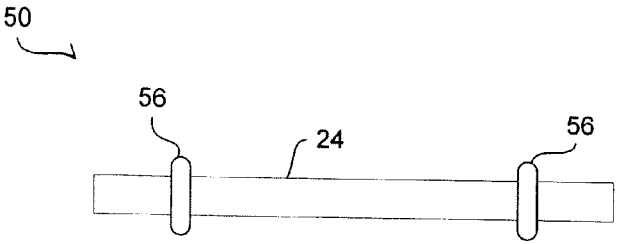
FIG. 5 is a diagram illustrating a stent mandrel according to another embodiment of the invention.

FIG. 5 is a diagram illustrating stent mandrel 50 according to another embodiment of the invention. The mandrel 50 is substantially similar to the mandrel 24 except that the mandrel 50 includes two cylinders 56, each having rounded smooth edges, in place of the spheres 48. The cylinders 56 have the same advantages as those mentioned above with respect to the spheres 48 since the cylinders 56 have non-sharp edges.

Figure 6:
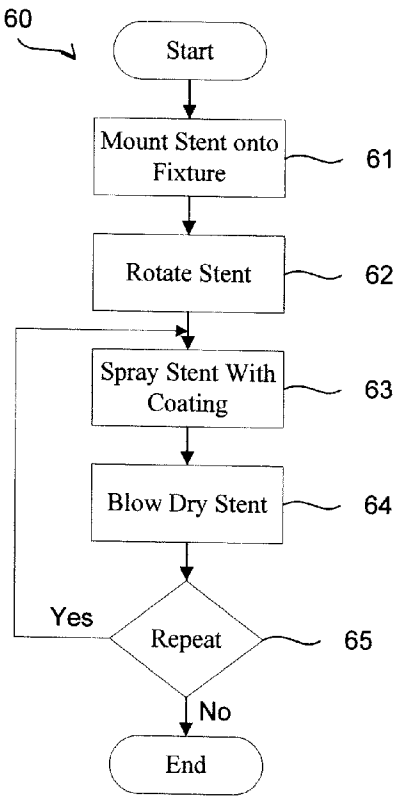
FIG. 6 is a flowchart illustrating a method of coating a stent.

FIG. 6 is a flowchart illustrating a method 60 of coating a stent. First a stent 10 is mounted (61) on a stent mandrel fixture, such as the stent mandrel fixture 20. Mounting (61) can include rotating the support member 22 vertically, inserting the mandrel 24 into the bore 38, placing the stent over the mandrel 24, and then inserting the mandrel 24 into the lock member 26. A high magnification video device can also be used during the mounting (61) to assist in adjusting the contact position between the spheres 48 or the cylinders 56 and the stent 10. The stent 10 is then rotated (62) and a coating is sprayed (63) on the stent 10 during the rotation (62). The stent is then blow dried (64) using an inert gas, such as Argon. The spraying (63) and drying (64) can be repeated (65) for multiple cycles with the same or different coating materials until a desirable thickness or weight is achieved. The method 60 then ends.

The foregoing description of the illustrated embodiments of the present invention is by way of example only, and other variations and modifications of the above-described embodiments and methods are possible in light of the foregoing teaching. For example, the cylinders 56 may also be coated with a non-stick polymeric material having less adhesive force with the coating substance than with the members.

What is claimed is:

1. A method of coating a stent, comprising:

inserting a member at least partially into a longitudinal bore of the stent, the member having at least one spherical component disposed within and supporting the stent and a slanted end adjacent a side of the stent;

rotating the member to thereby impart rotation to the stent, wherein the contact point between the stem and the spherical component constantly changes as the stent rotates; and applying a coating to a surface of the rotating stent including, (a) spraying the stent with a coating composition, (b) drying the stent, and repeating steps (a) and (b) several times until a desired coating thickness or coating weight is achieved, wherein the slanted end periodically deflects coating composition as the stent rotates.

2. The method of claim 1, wherein the spherical component has a diameter up to about 90% of an inner diameter of the stent.

3. The method of claim 1, wherein the member is a mandrel and the center of the spherical component is coincident with a rotational axis of the mandrel.

4. The method of claim 1, wherein the member is a mandrel and the center of the spherical component is offset from a rotational axis of the mandrel.

5. The method of claim 1, wherein the member has first and second spherical components disposed within and supporting the stent.

6. The method of claim 5, wherein the member is a mandrel and the centers of the first and second spherical components are coincident with a rotational axis of the mandrel.

7. The method of claim 5, wherein the member is a mandrel and the centers of the first and second spherical components are offset from a rotational axis of the mandrel.

8. The method of claim 1, further including the step of baking the stent after a final spraying and/or drying of the stent.

9. A method of coating a stent, comprising:

mounting a stent on a stent fixture including a mandrel disposed within and supporting the stent, wherein the stent fixture includes a first slanted end disposed adjacent one end of the supported stent and a second slanted end disposed adjacent an opposite end of the supported stent;

rotating the mandrel, thereby rotating the stent;

applying a coating to a surface of the rotating stent including, (a) spraying the stent with a coating composition, (b) drying the stent, and repeating steps (a) and (b) several times until a desired coating thickness or coating weight is achieved;

wherein the first and second slanted ends are arranged so that a spray bouncing off of the slanted ends imparts back and forth movement to the stent.

10. The method of claim 9, wherein the slanted ends have a slant angle of about 15 degrees to about 75 degrees from vertical.

11. The method of claim 9, wherein the slanted ends have a slant angle of about 30 degrees to about 60 degrees from vertical.

12. The method of claim 9, wherein the stent is supported upon at least one spherical component or cylindrical component.

13. The method of claim 9, wherein the first slanted end has a slant angle that is 180 degrees from the slant angle of the second slanted end.

14. The method of claim 9, wherein the rotating step includes rotating the mandrel using a motor coupled to the mandrel.

15. A method of coating a stent, comprising:

mounting a stent on a stent fixture including a mandrel disposed within and supporting the stent, wherein the stent fixture includes a first slanted end disposed adjacent one end of the supported stent and a second slanted end disposed adjacent an opposite end of the supported stent;

using a motor coupled to the mandrel, rotating the mandrel, thereby rotating the stent;

applying a coating to a surface of the rotating stent by spraying; and translating the stent fixture from a spraying station to a drying station after the applying a coating step;

wherein the first and second slanted ends are arranged so that a spray bouncing off of the slanted ends imparts back and forth movement to the stent.

16. A method of coating a stent to minimize coating defects, comprising:

mounting a stent on a stent fixture including a mandrel disposed within and supporting the stent;

rotating the mandrel about an axis using a motor coupled to the mandrel;

spraying the stent to apply a coating to a surface of the rotating stent;

the stent fixture further including a plurality of surfaces arranged to enable the stent to tumble during the spraying step, wherein at least one of the plurality of surfaces is a slanted surface disposed adjacent to, and outside of the bore of the stent;

drying the stent after the spraying step; and repeating the steps of spraying followed by drying multiple times until a desired coating thickness or coating weight is achieved.

17. The method of claim 16, wherein a first of the plurality of surfaces is arranged so that a contact point between the stent and mandrel constantly changes as the mandrel rotates about the axis.

18. The method of claim 17, wherein a second of the plurality of surfaces is disposed adjacent to a bore of the stent.

19. The method of claim 18, wherein a third of the plurality of surfaces is disposed adjacent one end of the stent bore and the second of the plurality of surfaces is disposed at another end of the stent bore.

20. The method of claim 19, wherein the stent periodically strikes the second and third surfaces as it tumbles.

21. The method of claim 17, wherein the first surface is a surface of a sphere.

22. The method of claim 16, wherein the slanted surface does not penetrate the bore of the stent.

23. A method of coating a stent, comprising:

inserting a member at least partially into a longitudinal bore of the stent, the member having at least one sphere disposed within and supporting the stent, the sphere having a diameter such that at least a portion of the sphere extends out through a gap and above an outer surface the stent;

rotating the member to thereby impart rotation to the stent, wherein the contact point between the stent and the spherical component constantly changes as the stent rotates; and applying a coating composition to a surface of the rotating stent.

24. The method of claim 23, wherein the applying a coating composition includes (a) spraying the stent with a coating composition, (b) drying the stent, and repeating steps (a) and (b) several times until a desired coating thickness or coating weight is achieved, wherein the slanted end periodically deflects coating composition as the stent rotates.

* * * * *